US007119501B2

(12) United States Patent
Young

(10) Patent No.: US 7,119,501 B2
(45) Date of Patent: Oct. 10, 2006

(54) DYNAMIC COLOR MIXING LED DEVICE

(75) Inventor: Garrett J. Young, Farmingdale, NJ (US)

(73) Assignee: Dialight Corporation, Farmingdale, NJ (US)

( * ) Notice: Subject to any disclaimer, the term of this patent is extended or adjusted under 35 U.S.C. 154(b) by 0 days.

(21) Appl. No.: 11/235,263

(22) Filed: Sep. 27, 2005

(65) Prior Publication Data

US 2006/0022614 A1 Feb. 2, 2006

Related U.S. Application Data

(63) Continuation of application No. 10/727,517, filed on Dec. 5, 2003.

(51) Int. Cl.
*G05F 1/00* (2006.01)

(52) U.S. Cl. ..... 315/307; 315/297; 315/291; 315/112; 315/117; 362/227; 362/800

(58) Field of Classification Search ..... 315/112, 315/117, 118, 224, 225, 291, 294, 297, 307, 315/292, 316; 362/227, 231, 234, 294, 373, 362/800

See application file for complete search history.

(56) References Cited

U.S. PATENT DOCUMENTS 6,016,038 A 1/2000 Mueller et al. ..... 315/291
6,166,496 A * 12/2000 Lys et al. ..... 315/316
6,211,626 B1 4/2001 Lys et al. ..... 315/291
6,956,337 B1 * 10/2005 Kemper ..... 315/307
6,963,175 B1 * 11/2005 Archenhold et al. ..... 315/291
6,964,501 B1 * 11/2005 Ryan ..... 362/294
2004/0052076 A1 3/2004 Mueller et al. ..... 362/293
2004/0120156 A1 6/2004 Ryan ..... 362/294
2005/0122065 A1 * 6/2005 Young ..... 315/294

* cited by examiner

*Primary Examiner*—Haissa Philogene
(74) *Attorney, Agent, or Firm*—Oblon, Spivak, McClelland, Maier & Neustadt, P.C.

(57) ABSTRACT

A dynamic color mixing LED device that includes a plurality of light emitting diode units. Each light emitting diode unit includes e.g. a first LED of a first color (e.g. red) and a second LED of a second color (e.g. green). A third LED of a third color (e.g. blue can also be provided). A controller supplies respective driving signals to each of the first LED, second LED, and third LEDs individually. The respective driving signals individually control relative intensity outputs of the respective first LED, second LED, and third LED. With such an individual control each of the light emitting diode units can be controlled to output different color signals.

18 Claims, 3 Drawing Sheets

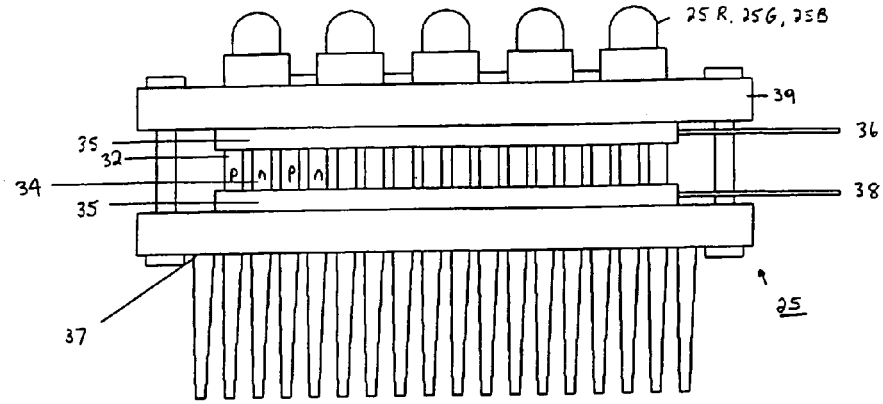
FIG. 3
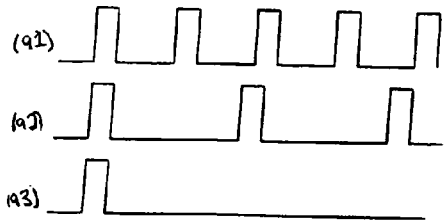
FIG. 4a
FIG. 4b
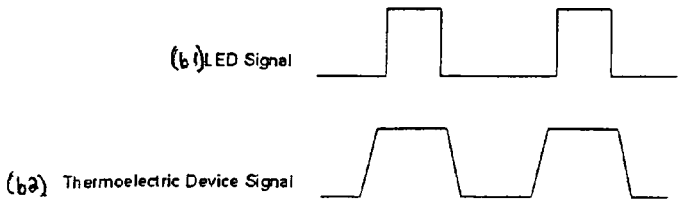

DYNAMIC COLOR MIXING LED DEVICE

BACKGROUND OF THE INVENTION

1. Field of the Invention

The present invention is directed to a light emitting diode (LED) device with a dynamic color mixing scheme-so that the LED device can efficiently and effectively output a wide range of colors.

2. Discussion of the Background

All colors are formed of different combinations of red, green, and blue (RGB) components. Controlling the relative intensity ratio of the different contributions of red, green, and blue components allows multiple colors to be displayed. The quantity of possible colors is proportional to the accuracy of incrementing the ratio between the different color components of red, green, and blue. A broader spectrum of colors can be achieved when each component's contribution is precisely controlled.

As an example, if each of red, green, and blue component contributions can be controlled in 256 increments, then 16.7 million precise ratios or colors are possible ($256^3$). FIG. 1 graphically shows how-the three different components of red, green, and blue can be utilized to form any color. FIG. 1 specifically shows how the different contributions of red, green, and blue (RGB) can form any of the colors of cyan (C), white (W), yellow (Y), and magenta (M), or any colors therebetween.

As a concrete example evident from FIG. 1, the color magenta (M) is produced when the blue (B) and red (R) components are at the maximum value and the green (G) component is at a minimal value of zero. That is, the color magenta (M) can be formed by maintaining the components of red (R), green (G), and blue (B) to be (255, 0, 255).

SUMMARY OF THE INVENTION

The present inventor recognized that currently devices utilizing light emitting diodes (LEDs) are not widely utilized in color type displays. However, the present inventor also recognized that with the onset of LEDs of different colors becoming more prevalent, inexpensive, and reliable, forming a color display with LEDs would be beneficial for the many reasons that LED use is expanding, specifically long life of LEDs, low power consumption of LEDs, etc.

Accordingly, one object of the present invention is to provide a novel LED device that allows dynamic color mixing.

A further object of the present invention is to allow the appropriate control of signals provided to different elements of the novel LED device to allow the dynamic color mixing.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 3 shows a thermoelectric device used in the device of FIG. 2;

FIGS. 4*a* and 4*b* show different input signals utilized in the device of FIG. 2.

DESCRIPTION OF THE PREFERRED EMBODIMENTS

Figure 1:
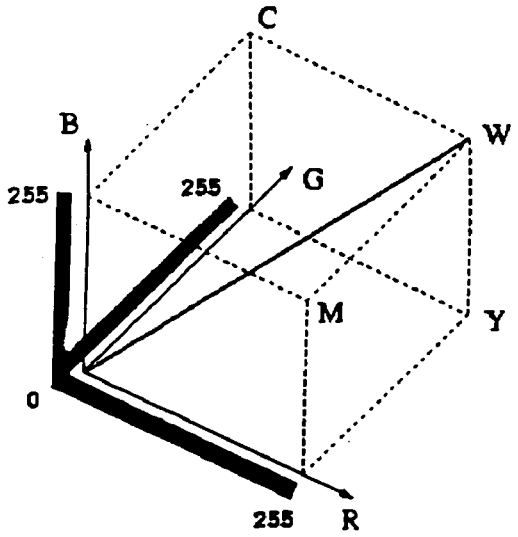
FIG. 1 describes a mixing of different color components of red, green, and blue to form any color.
Figure 2:
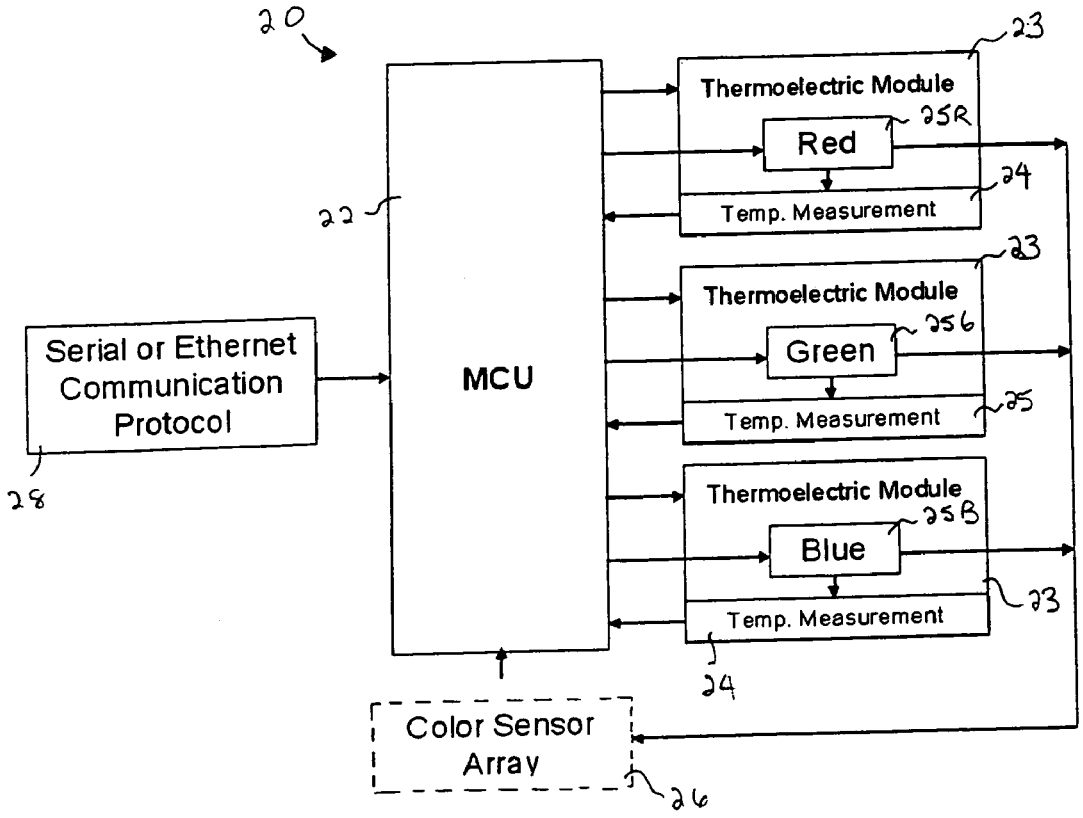
FIG. 2 shows an overall view of a dynamic color mixing LED device of the present invention.

Referring now to the drawings, wherein like reference numerals designate identical or corresponding parts throughout the several views, and more particularly to FIG. 2 thereof, an overall view of a dynamic color mixing LED device 20 of the present invention is shown.

As shown in FIG. 2, the dynamic color mixing LED device 20 includes a microprocessor control unit (MCU) 22 connected to plural thermoelectric modules 23, one thermoelectric module 23 being provided for each of different LEDs. Each thermoelectric module 23 is provided for a respective of three different color LEDs, which in this embodiment include a red LED 25R, a green LED 25G, and a blue LED. 25B. The MCU 22 provides driving signals to each individual red 25R, green 25G, and blue 25B LED and to each thermoelectric module 25.

The present invention is directed to a device that can mix colors output from different color LEDs. In the example noted in FIG. 2 the LEDs are of colors red, blue, and green. The present invention is also applicable to utilizing fewer LEDs, e.g. a color mixing can clearly be realized by mixing colors from only two LEDs, utilizing. LEDs of different colors, for example LEDs that output colors of magenta, cyan, and yellow could also be used, etc. Any desirable combination of any number of different color LEDs is applicable in the present invention.

The applicant of the present invention recognized that a very precise temperature control of the individual LEDs 25R, 25G, and 25B provides significantly enhanced results in such a color mixing device. Precise temperature control is significantly beneficial because ambient temperature effects dominant wavelength and LED die efficiency or intensity at a given applied power. Small changes in dominant wavelength can cause dramatic shifts in chromaticity. Thereby, by precisely controlling the temperature at each LED undesirable shifts in chromaticity can be avoided, and precise color control can be realized.

As discussed in further detail below an LED control operation can constantly monitor temperature and integrate current over time to compensate for dominant wavelength shift and intensity degradation. As also discussed in further detail below, at a given current and ambient temperature the luminous intensity of an LED degrades over time. As a further feature in the present invention discussed in further detail below the drive conditions are compensated based on a mathematical function that monitors temperature and integrates the current with respect to time. The algorithm can also regulate the thermoelectric modules 23 to precisely control the LED temperature and minimize dominant wavelength shift. Thereby, constant color and intensity over time and ambient temperature can be provided.

As shown in FIG. 2 each LED 25R, 25G, and 25B is in contact with a respective thermoelectric module 25. The structure of such a thermoelectric module with corresponding LED's 25R, 25G, 25B of one particular color mounted thereon is shown in detail in FIG. 3. In the embodiment of FIG. 2 three of such devices in FIG. 3, one for each color of LED, would be provided. As shown in FIG. 3 each thermoelectric module 25 includes a pair of ceramic substrates 35. Formed between the ceramic substrates 35 are p-type semiconductor pellets 32 and n-semiconductor pellets 34. A positive input 36 and a negative input 38 are also provided to the ceramic substrates 35. A support substrate 39 for the LED's 25R, 25G, 25B, and a heat sink 37 are also provided.

Such a thermoelectric module 25 is a solid state semiconductor device that functions as a heat pump using the Peltier effect. Such a thermoelectric module and its operation are known in the art. In such a thermoelectric module 25 the power applied is directly proportional to the quantity of the heat pumped, and thereby the thermoelectric module 25 can operate as an effective temperature regulator for an LED contacting either of the ceramic substrates 35, and therefore the LED temperature can be precisely controlled.

In FIG. 3 such a thermoelectric module 25 includes a cold side at which heat is absorbed, the side of one of the ceramic substrates 35, and a hot side at which heat is rejected, the side of the other ceramic substrates 35. In such a structure an LED is mounted on either of the heat absorbing side or heat rejecting side so that the temperature at the LED can be precisely controlled. The direction in which the heat is pumped can be controlled by the polarity of the applied voltage from the conductors 36, 38 or the direction of current. The heat absorbing and rejecting sides can be switched by reversing the polarity of the applied signal. One of the ceramic substrates 35 is also thermally connected to the heat sink 37 for dissipating heat, although an alternative heat dissipating structure such as a heat pipe or other appropriate heat dissipating structure could be employed.

Further, in FIG. 2 a separate thermoelectric module 23 is shown for each different color LED. However, when utilizing red, green, and blue LEDs the influence of temperature on the red LED 25R is most prevalent. In one specific example, in an LED an AlInGaP die (i.e. red or yellow) may be the most effected by temperature and therefore that die is the most important one to have control of the temperature. Therefore, it is possible to only precisely control the dominant wavelength and light output of the red LED 25R in such an embodiment. Thereby, it is possible that if a less precise color control is needed only the thermoelectric module 23 provided for the red LED 25R may be utilized and the other thermoelectric modules 23 provided for the green LED 25G and blue LED 25B can be omitted. Of course if different color LEDs or in different circumstances different thermoelectric modules can be utilized or deleted.

FIG. 2 also shows the red 25R, green 25G and blue 25B LEDs in a conceptual arrangement. Based on what type of color display device is desired to be effectuated those LEDs 25R, 25G, and 25B can be provided in different ways with different accompanying optics based on the specifically desired color mixing device. For example, the red 25R, green 25G, and blue 25B LEDs could be arranged in clusters with or without collimating optics. The optics could be collimating, prismatic, or reflective in nature to combine the emitted light beams from each individual LED. The LED spacing within each cluster will vary based on the desired optical approach. Thus, the implementation of the LED arrangement of the individual LEDs 25R, 25G, and 25B has multiple possibilities based on a desired usage. Further, the number of clusters of individual LEDs, i.e. the number of groups of a red 25R LED, a green 25G LED, and a blue 25B LED, will also vary based on a desired color mixing scheme.

Also connected to each of the thermoelectric modules 25 are respective temperature measurement devices 24. Those temperature measurement devices 24 measure the temperature at the individual 25R, 25G, 25B LED elements. Those temperature measurement devices 24 can take the form of any type of heat sensor, such as a thermocouple or an arrangement that monitors LED forward voltage changes to extrapolate a die temperature at the respective LED. Further, outputs of each of the temperature measurement devices 24 are also provided to the MCU 22. The MCU 22 can receive signals indicating the temperatures at the individual red 25R, green 25G, and blue 25B LEDs and can thereby control the driving signals provided to the individual red 25R, green 25G, and blue 25B LEDs and thermoelectric modules 23. In such a way a temperature feedback can be effectuated.

Also, a serial or Ethernet communication protocol 28 is connected to the MCU 22. This communication protocol allows signals to be communicated to allow remote control of the MCU 22, to thereby allow remote control of color or to allow interactive viewing of the status of the system.

Also, a color sensor array 26, which is an optional element, can be optically connected to the red 25R, green 25G, and blue 25B LEDs and to the MCU 22. That color sensor array 26 is provided to detect the color output by each cluster of LEDs. Based on the detected output colors by the color sensor array 26, a feedback signal can be provided to the MCU 22 to control the driving of the individual red 25R, green 25G, and blue 25B LEDs. In such a way a color feedback can also be effectuated.

To properly control the different contributions of the different red 25R, green 25G, and blue 25B LED components, appropriate driving signals must be individually provided to each of the red 25R, green 25G, and blue 25B LED components.

The human eye integrates intensity over a short period of time. Therefore, switching the red, green, and blue LEDs at high rates while controlling the ON/OFF ratio of pulses applied thereto allows manipulation of the average relative intensity of each respective LED.

One manner in which the average relative intensity of the different LED components can be controlled is by frequency modulating the individual driving signals provided to each respective LED. Frequency modulation is effectuated by providing a fixed pulse width at a variable frequency, to thereby control the duty cycle. FIG. 4*a* shows such a frequency modulation scheme in which the signal (a1) in FIG. 4*a* would provide the greatest intensity, the signal (a2) would provide an intermediate intensity, and the signal (a3) would provide the least intensity. By individually modulating the driving signals provided to the respective red 25R, green 25G, and blue 25B color LED components, each of their individual contributions towards a displayed color can be closely regulated.

FIG. 4*b* illustrates the nature of the thermoelectric device signal (b2) compared to the LED driving signals of Figure (b1). Both such signals are frequency modulated to control the duty cycle of the element. The thermoelectric device, however, needs to be synchronized with the LED driving signals and the fixed pulse width needs to be modified such that the LED is cooled before turn-on. The pre-cooling allows the instantaneous die temperature to be controlled. The semiconductor die emits light only for the duration of the pulse, and in that duration, the instantaneous die temperature can significantly exceed the average temperature. Therefore, the pre-cooling, effectuated by the ramping-up of the signal provided to the thermoelectric module, is preferably synchronized and is longer than the pulse provided to the LED so that the instantaneous die temperature remains constant at any given current pulse. The signals shown in FIGS. 4(*b*1), 4(*b*2) show an example of achieving such a result.

In the disclosed device the frequency and pulse width are less critical than the duty cycle of the LED drive waveform.

Equations [1]–[3] noted below provide a system of equations that can be utilized to determine the parameters of the frequency modulated signal. Specifically equation [1] below calculates the fixed pulse width of the signal for a system with a total number of increments or steps that equal $Step_{max}$. Equation [2] below calculates the cycle time of one period for a given frequency that in turn allows the computation of the duty cycle of the signal using equation [3].

$$t_{pulse} = \frac{1}{f_{base}(Step_{\mathrm{MAX}})} \quad [1]$$

$$t_{cyc} = \frac{1}{f} \quad [2]$$

$$D = \frac{t_{pulse}}{t_{cyc}} \quad [3]$$

In the above equations $f_{base}$ is the base frequency (Hz), $t_{cyc}$ represents the waveform cycle time (seconds), $t_{pulse}$ denotes the fixed pulse width (seconds), $Step_{MAX}$ symbolizes the maximum increment or step, and D is the waveform duty cycle (%).

The Table 1 below illustrates a four step or increment system and associated values for a modulated signal using a base frequency of 500 Hz.

In the above-noted equations and in the illustration of Table 1 the frequency of the signal for the first step is defined as the base frequency. The subsequent incremented frequencies are the product of the step number and base frequency. The base frequency is chosen to account for the switching requirements of electronic components; audible and electronic noise, and human factors including smoothness of transition and consistency of average intensity.

TABLE 1

| Step | Frequency (Hz) | $T_{pulse}$ (usec) | $T_{cyc}$ (usec) | Duty Cycle (%) |
|---|---|---|---|---|
| 1 | 500 | 500 | 2000 | 25 |
| 2 | 1000 | 500 | 1000 | 50 |
| 3 | 1500 | 500 | 667 | 75 |
| 4 | 2000 | 500 | 500 | 100 |

In addition to the frequency modulation, the individual LED control signals provided to each of the individual red 25R, green 25G, and blue 25B LED elements can be amplitude modulated as well, for various reasons now discussed. Each individual LED component may have a different forward voltage, luminance efficiency, degradation curve, and dominant wavelength temperature dependence between LED die technologies, which gives benefits to pulse amplitude control of individual channels. Utilizing an amplitude modulation also eliminates a total current, proportional to output light intensity, difference between displayed colors. The combination of frequency and amplitude modulation can allow time-consistent color and intensity regardless of temperature or selected hue.

The control operation for controlling the individual driving signals to the individual LED elements, for implementing the amplitude modulation, can constantly monitor temperature at the individual LED elements and integrate currents supplied to the different individual LED elements over time to compensate for a dominant wavelength shift and intensity degradation. Ambient temperature effects dominant wavelength and LED die efficiency and intensity at a given applied power. Small changes in the dominant wavelength can cause dramatic shifts in chromaticity Further, at a given current and ambient temperature, the luminance intensity of an LED degrades over time.

One operation executed by the controller is to compensate the driving conditions for each individual LED element, i.e., control the driving signals provided to each individual LED element, based on the following mathematical function [4] that monitors temperature and integrates the current supplied to the different LEDs with respect to time.

$$D_F(t) = m_{LED}\int_o^t I_{LED}\,dt + b \quad [4]$$

In equation [4] $D_F$ is the long term intensity degradation factor, $m_{LED}$ denotes the degradation slope, $I_{LED}$ denotes intensity of the LED, and b represents the time (t) offset. By utilizing the above-noted equation the pulse amplitude is adjusted based on the long-term intensity degradation function.

With such a control by the controller constant color intensity and chromaticity over time and ambient temperatures can be realized.

Instead of utilizing the above-noted mathematical function, an active feedback can be provided by the color sensor array 26. That color sensor array 26 can take simple measurements of output color of the different LED components. The above-noted LED control algorithm also supports receiving signals from such a color sensor array. That algorithm can also run remotely and receive communications through standard serial protocols or run locally via a microcontroller.

FIG. 4 shows an overall control operation executed in the present invention. In FIG. 4 the term "(color)" indicates a reference to any of the red, green, or blue colors or LEDs. As shown in FIG. 4 a (color) frequency modulation control 40 is provided utilizing the equations [1]–[3] noted above. Outputs from the frequency modulation control 40, i.e., the frequency modulation signals, are provided to a (color) thermoelectric device control 44. Also provided to the thermoelectric device control 44 are outputs from temperature measurement devices 24, which outputs can take the form of, for example, a monitored LED forward voltage providing an indication of temperature monitoring. Also, an output of the frequency modulation control 40 is provided to an amplitude modulation control 42 that generates an amplitude modulation signal, such as based on equation [4] noted above. The output of that amplitude modulation control 42 is also provided to the thermoelectric device control 44. A degradation slope control 45 is also input to the amplitude modulation control 42. The LED degradation slope, i.e. the rate of intensity loss over time at a specific current, is provided by the LED manufacturer or can be experimentally determined. That value is used in equation [4].

An output from a data decodes and module distribution control 41 is provided to both of the frequency modulation control 40 and the amplitude modulation control 42. The data decode and module distribution control 41 interfaces between external data and the modulation algorithms. This interface control translates serial, Ethernet, or stored data into input variables for the frequency modulation control 40 and the amplitude modulation control 42. The data decode and module distribution control 141 also transmits the status of the MCU 22 control elements using a serial or Ethernet communication protocol.

A connection from the remote data serial or Ethernet communication protocol unit 28 to the data decodes and module distribution control 42 is also provided. Also provided to the data decode and module distribution control 41 are a preset local data control 46 and a color sensor data control 47, which are optional elements. The preset local data control 46 allows the device to display a predetermined array of colors and sequences, and the color sensor data control allows providing information detected by the optional color sensor array 26 of FIG. 2.

Figure 5:
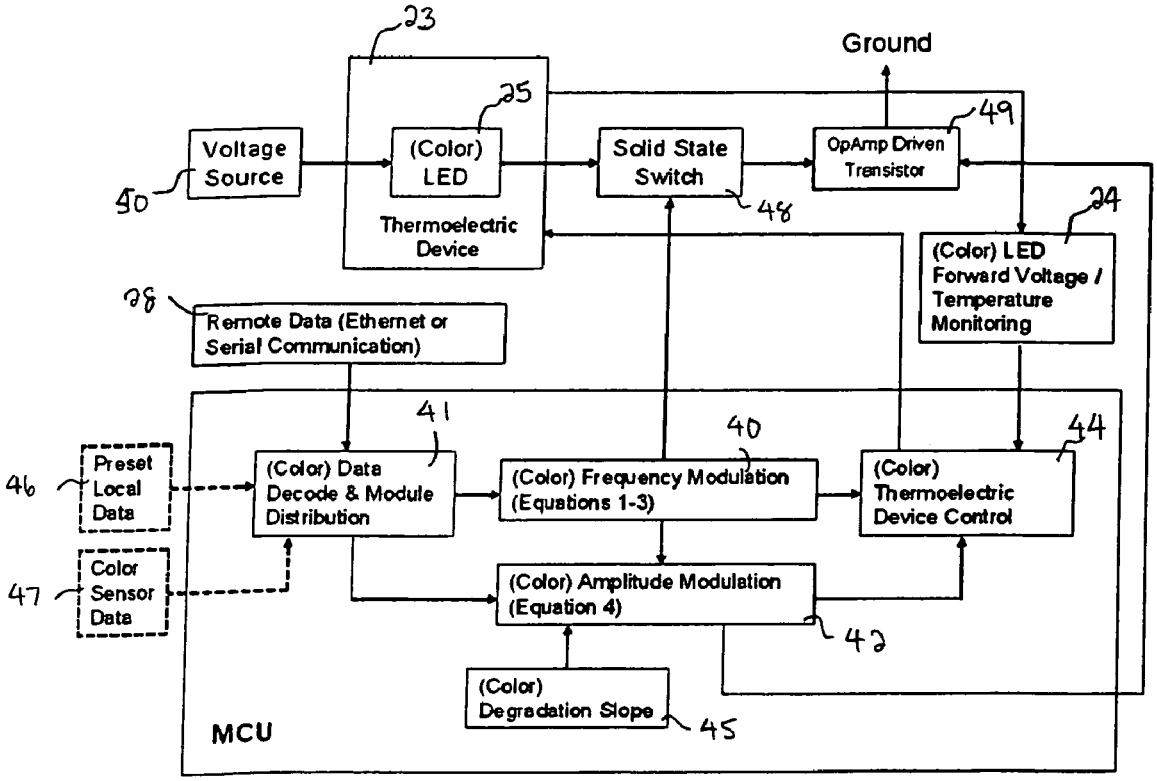
FIG. 5 shows a block diagram of an overall control operation utilized in the device of FIG. 2.

As shown in FIG. 5, an output from the frequency modulation control 40 is provided to a solid state switch 48. An output from the thermoelectric device control 44 is provided to the thermoelectric device 23. As also shown in FIG. 5 a voltage source 50 provides a voltage to each color LED 25, and the output of each color LED 25 is provided to the solid state switch 48. An output of the solid state switch 48 is also provided to an optional amplifier.(OpAmp) driven transistor 49, which is also connected to ground. That OpAmp driven transistor 49 also receives an output from the amplitude modulation control 42. The solid state switch 48, which for example can be a MOSFET, turns the LEDs 25R, 25G and 25B on/off in accordance with the frequency modulated signal provided thereto from the frequency modulation control 40. The OpAmp driven transistor 49 regulates the maximum current pulse height, amplitude modulation, dependent on a control signal from the MCU 22.

Obviously, numerous modifications and variations of the present invention are possible in light of the above teachings. It is therefore to be understood that within the scope of the appended claims, the present invention may be practiced otherwise than as specifically described herein.

The invention claimed is:

1. A dynamic color mixing device comprising:

(a) at least one light emitting diode (LED) unit each including:

(a1) a first LED of a first color; and (a2) a second LED of a second color;

(b) a controller configured to supply respective driving signals to each of said first LED and second LED individually, said respective driving signals individually controlling relative intensity outputs of said respective first LED and second LED; and (c) a temperature sensor configured to sense a temperature at at least a portion of said at least one LED unit, and wherein said controller further monitors the sensed temperature of said at least one LED unit and integrates a current supplied to said at least one LED unit, and controls the amplitude modulation based on the monitored temperature and integrated current, to maintain a constant color intensity and chromaticity over time and ambient temperatures.

2. A dynamic color mixing device according to claim 1, wherein said at least one LED unit further includes (a3) a third LED of a third color, and said controller is further configured to supply a respective driving signal to individually control a relative intensity output of said third LED.

3. A dynamic color mixing device according to claim 2, further comprising:

(d) temperature regulators configured to maintain a desired temperature at each of said first LED, said second LED, and said third LED.

4. A dynamic color mixing device according to claim 3, wherein each temperature regulator comprises a thermoelectric device.

5. A dynamic color mixing device according to claim 2, wherein said controller individually frequency modulates the respective driving signals supplied to each of said first LED, second LED, and third LED to individually control their relative intensity outputs.

6. A dynamic color mixing device according to claim 5, wherein said controller further amplitude modulates the respective driving signals supplied to each of said first LED, second LED, and third LED.

7. A dynamic color mixing device according to claim 2, wherein said first LED is a red LED, said second LED is a green LED, and said third LED is a blue LED.

8. A dynamic color mixing device according to claim 1, wherein said controller is further configured to control said temperature sensor based on the monitored temperature and integrated current.

9. A dynamic color mixing device according to claim 6, further comprising:

a color sensor array configured to sense colors of light output from at least a portion of said at least one LED unit; and wherein said controller is further configured to control the amplitude modulation based on the sensed colors.

10. A dynamic color mixing device comprising:

(a) at least one light emitting diode (LED) unit each including:

(a1) a first LED of a first color; and (a2) a second LED of a second color;

(b) means for supplying respective driving signals to each of said first LED and second LED individually, said respective driving signals individually controlling relative intensity outputs of said respective first LED and second LED; and (c) means for sensing a temperature at at least a portion of said at least one LED unit. and wherein said means for supplying further monitors the sensed temperature of said at least one LED unit and integrates a current supplied to said at least one LED unit, and controls the amplitude modulation based on the monitored temperature and integrated current, to maintain a constant color intensity and chromaticity over time and ambient temperatures.

11. A dynamic color mixing device according to claim 10, wherein said means for supplying further controls said means for sensing based on the monitored temperature and integrated current.

12. A dynamic color mixing device according to claim 10, wherein said at least one LED unit further includes (a3) a third LED of a third color, and said means for supplying is further configured to supply a respective driving signal to individually control a relative intensity output of said third LED.

13. A dynamic color mixing device according to claim 12, further comprising:

(d) means for maintaining a desired temperature at each of said first LED, said second LED, and said third LED.

14. A dynamic color mixing device according to claim 13, wherein said means for maintaining comprises a thermoelectric device.

15. The dynamic color mixing device according to claim 12, wherein said means for supplying further individually frequency modulates the respective driving signals supplied to each of said first LED, second LED, and third LED to individually control their relative intensity outputs.

16. A dynamic color mixing device according to claim 15, wherein said means for supplying further amplitude modulates the respective driving signals supplied to each of said first LED, second LED, and third LED.

17. A dynamic color mixing device according to claim 16, further comprising:

means for sensing colors of light output from at least a portion of said at least one LED unit; and wherein said means for supplying further controls the amplitude modulation based on the sensed colors.

18. A dynamic color mixing device according to claim 12, wherein said first LED is a red LED, said second LED is a green LED, and said third LED is a blue LED.

* * * * *